US005538420A

United States Patent [19]

Klobucar et al.

[11] Patent Number: 5,538,420

[45] Date of Patent: Jul. 23, 1996

[54] HEAT EXCHANGER BAKE OUT PROCESS

[75] Inventors: Joseph M. Klobucar, Plymouth; Gordon M. Harbison, Canton, both of Mich.

[73] Assignee: Durr Industries, Inc., Plymouth, Mich.

[21] Appl. No.: 342,730

[22] Filed: Nov. 21, 1994

[51] Int. Cl.[6] ..... F27D 17/00

[52] U.S. Cl. ..... 432/2; 432/180; 432/181

[58] Field of Search ..... 432/179, 180, 432/181, 75, 2; 137/309

[56] References Cited

U.S. PATENT DOCUMENTS

| | | | |
|---|---|---|---|
| 5,101,741 | 4/1992 | Gross et al. . | |
| 5,240,403 | 8/1993 | McAnespie | 432/181 |
| 5,259,757 | 11/1993 | Plejdrup et al. | 432/181 |
| 5,297,954 | 3/1994 | Colagiovanni | 431/5 |

*Primary Examiner*—Thomas E. Denion
*Attorney, Agent, or Firm*—Howard & Howard

[57] ABSTRACT

A heat exchanger burn-out process for regenerative thermal oxidizers includes the steps of passing a super-heated gas through one of the heat exchangers and into the combustion chamber. The gas is preferably heated in a selectively opened injection line that includes a burner. The burner is designed to superheat the injection gas to a cleaning temperature. The cleaning temperature is selected to be high enough as to volatilize and/or combust the organic solids that are expected within the heat exchanger. The injection line is associated with one of the heat exchangers, and the other two of the normal three heat exchangers on the regenerative thermal oxidizer are switched between a supplemental injection mode, wherein cooling gas is injected through that heat exchanger, and an outlet mode wherein gas from the combustion chamber leads outwardly through the heat exchanger to an outlet manifold. The supplemental injection line reduces the overall temperature of the gas leaving the system through the outlet manifold. In one embodiment, the heated injection line is associated with the inlet manifold, and the supplemental injection line is associated with the purge manifold. In a second embodiment, the heated injection line is associated with the purge manifold and the supplemental injection line is associated with the inlet manifold.

13 Claims, 1 Drawing Sheet

HEAT EXCHANGER BAKE OUT PROCESS

BACKGROUND OF THE INVENTION

This invention relates to a method of directing a heated gas through a heat exchanger in a regenerative thermal oxidizer and into the combustion chamber to volatilize or combust any solids that may have accumulated within the heat exchange elements.

Regenerative thermal oxidizers ("RTO") are known, and are often utilized to remove volatile organic compounds ("VOC's") from an air stream. The air stream is typically process gas from another industrial process, such as a paint spray booth. The RTO removes the VOC's from the air stream by passing the process or "dirty" gas through a first previously heated heat exchanger and into a combustion chamber. The "dirty" gas is combusted and cleaned in the heat exchanger chamber. At the same time, a second heat exchanger is receiving heated clean air from the combustion chamber. After a period of time, the flow of cool dirty gas and heated clean gas are switched between the heat exchangers. Thus, the first heat exchanger that had previously been hot and was heating the dirty gas is switched to receiving the hot clean gas. The first heat exchanger is then again heated. The second heat exchanger that had been receiving the hot clean gas is switched to receiving the cool dirty gas and preheats that gas on its way to the combustion chamber. In this way, the regenerative thermal oxidizer continuously processes gas and efficiently removes impurities from a gas flow.

In many prior art RTO systems, a purge cycle is also included. When the heat exchangers are switched from receiving the dirty gas to the cool clean gas, there may sometimes be some residual dirty gas remaining in the heat exchanger. The clean gas is directed back to atmosphere, and no dirty gas should remain in the heat exchanger that begins to receive the clean gas. Thus, the prior art has included the purge cycle which drives residual dirty gas from a heat exchanger prior to that heat exchanger being switched to an outlet mode where it receives the clean gas. In many applications, RTO systems include a third heat exchanger such that the processing can continue at all times, with one heat exchanger being in an inlet mode receiving cool dirty gas, one heat exchanger being in an outlet mode receiving hot clean gas, and the third heat exchanger being in the purge mode.

Problems exist with such systems in that the heat exchange elements within the heat exchanger often accumulate organic solids from the air flow. The air flow containing the dirty gas tends to be in a first direction through the heat exchanger, and the air flow containing the clean gas is typically in an opposed direction. The heat exchange elements are often small particles of ceramic or other materials with good heat transfer properties. Such small particles or saddles, as they are typically known, provide numerous complex surface areas that can easily accumulate a good deal of organic waste. Thus, the heat exchanger elements will often accumulate organic solids. Further, the flow lines leading to the heat exchanger, and in particular the inlet manifold valves and flow lines often also build up accumulated solids.

The prior art has typically cleaned these heat exchangers by locking the valves in a first position such that the outlet gas continues to pass through a given heat exchanger for an unusual length of time. That outlet gas raises the temperature of the heat exchange elements to bake out any accumulated organic solids. However, this system has not been as efficient as desired. Moreover, since the cleaning gas is passing in a different direction than the direction at which the organic solids are placed on the heat exchange elements, it may not always be as effective as would be desirable.

SUMMARY OF THE INVENTION

In a disclosed embodiment of this invention, flow structure is modified to include an optional burn-out injection passage selectively communicating with one of the standard flow passages leading through the heat exchanger and into the combustion chamber. The injection line is also provided with a cleaning burner. When a heat exchanger is being cleaned, the standard flow passage is closed and the injection line is opened to the heat exchanger. Cleaning air passes through the cleaning burner and is heated to a cleaning temperature. The cleaning temperature is selected to be above the temperature at which the accumulated solids on the heat exchanger would be volatilized and/or combusted. This heated air passes through the flow manifold and valves, through the heat exchanger being cleaned, and into the combustion chamber. At the same time, clean air is passing from the combustion chamber through another of the heat exchangers.

Since the heated cleaning air is passing through the heat exchanger in a different direction than that normally taken by the process heated clean air, the optional burn-off cleaning air passing through that heat exchanger provides a thorough and efficient cleaning of the heat exchange elements.

In a preferred embodiment of this invention, the RTO includes at least a third heat exchanger, and the third heat exchanger is also placed in a mode such that it passes gas through the heat exchanger and into the combustion chamber. Thus, in a preferred method according to this invention, the heated burn-out gas is passed into a first heat exchanger, and a second or supplemental cool gas is passing into the combustion chamber through a second of the heat exchangers. The two gas flows combine in the combustion chamber and together pass outwardly through the third heat exchanger. Most preferably the second and third heat exchanger are cyclically switched as the first heat exchanger is maintained in the burn-out mode. The supplemental cool gas passing minimizes the temperature of the gas passing outwardly of the third heat exchanger. The RTO system is configured such that it typically combusts a gas passing through the first heat exchanger that was initially cool, rather than the super-heated cleaning gas. Thus, the temperature leaving the third heat exchanger may be higher than is desirable. By passing the supplemental cool gas through the second heat exchanger, that temperature in the third heat exchanger is somewhat lowered. In a most preferred embodiment of this invention, a fan is placed on the discharge passage downstream of the heat exchangers, and an air bleed is added to provide additional cooling air to the discharge passage, as necessary, to protect the fan from super-heated temperatures.

In a first embodiment of this invention, the optional burn-out gas is provided into the inlet manifold. In this method, the supplemental gas flows through the purge manifold. The supplemental gas is preferably distinct from the normal purge gas provided from the discharge passage.

In a second embodiment according to this invention, the optional burn-out gas is provided through the purge line, and is a gas other than the standard purge gas. In this method, the supplemental gas would typically be through the inlet line. This supplemental gas may be the normal process gas or may be a clean gas from some other source.

The apparatus according to this invention includes a RTO including at least two heat exchangers. Preferably, it would be a three-heat exchanger RTO. The passages leading into the heat exchanger and through the heat exchanger to the combustion chamber are provided with a separate injection line and a burner mounted on that separate injection line. The burner is capable of heating the air to a cleaning temperature above the temperature at which the organic solids that are to be expected on the heat exchanger elements would be volatilized and/or combusted. It should be understood that once the particular organic solids that are expected on the heat exchanger are identified, a worker of ordinary skill in the art would be able to identify the required cleaning temperature. It would then be a simple matter to determine the size of the cleaning burner necessary to heat the burn-out air leading through the heat exchanger for cleaning.

In a method according to this invention, air is heated and injected at the cleaning temperature through a first heat exchanger. The second and third heat exchangers are cyclically switched between being in an outlet and a supplemental injection mode. In the supplemental injection mode, a relatively high volume of air is passed into the heat exchanger to add additional air into the combustion chamber, to provide some cooling of the air leaving the other heat exchanger.

These and other features of this invention can be best understood from the following specification and drawings, of which the following is a brief description.

DETAILED DESCRIPTION OF A PREFERRED EMBODIMENT

Figure 1:
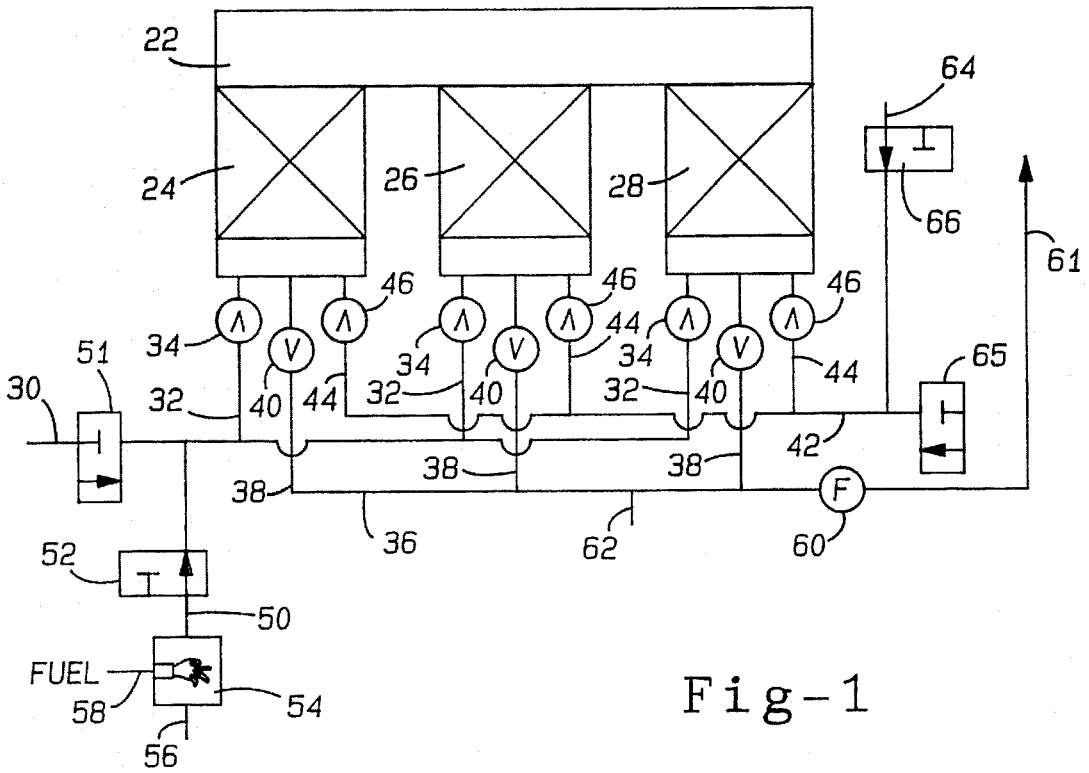
FIG. 1 is a schematic view of a regenerative thermal oxidizer including a first embodiment bake out system.

A regenerative thermal oxidizer 20 incorporates a combustion chamber 22 and three heat exchangers 24, 26 and 28. Combustion chamber 22 is typically provided with a burner. As is known, an inlet manifold 30 communicates a dirty process gas through one of the inlet branches 32 leading to each of the heat exchangers 24, 26 and 28. Inlet valves 34 are mounted on each inlet branch 32. An outlet manifold 36 communicates with an outlet branch 38 from each of the three heat exchangers. An outlet valve 40 is mounted on each outlet branch 38. A purge manifold 42 communicates with the source of clean gas, shown here as the outlet manifold 36. Purge manifold 42 communicates through a purge branch 44 with each of the heat exchangers 24, 26 and 28. Each purge branch 44 incorporates a purge valve 46.

As is known, when processing dirty air from inlet manifold 30, one inlet valve 34 is typically open. Air passes through that inlet valve, and into one of the heat exchangers 24, 26 and 28, which had been previously heated by clean outlet gas passing into the discharge manifold 36. The process air leading through the inlet branch 32 is thus preheated by the heat exchanger, and is combusted in the combustion chamber 22. That heated clean gas then moves through one of the other heat exchangers which has an open outlet valve 40, and into the outlet manifold 36. The heat exchangers are cyclically switched between being in the inlet and outlet mode. Between the time a heat exchanger is in the inlet mode and the time it is switched to the outlet mode, it may undergo a purge cycle. In the purge cycle, the inlet valve 34 and the outlet valve 40 are typically closed, and the purge valve 46 is opened on that heat exchanger. Purge gas passes through the heat exchanger to remove any residual gas. Various modifications of this basic operation are known, and the above is intended as a basic description of the typical regenerative thermal oxidizer operation.

With the present invention, an injection line is provided to inject a super-heated air through one of the heat exchangers 24, 26 and 28 to burn out that heat exchanger and remove any accumulated organic solids.

In the embodiment 20 shown in FIG. 1, the injection line 50 communicates through a normally closed damper valve 52 with the inlet manifold 30. A normally open damper valve 51 is positioned upstream on manifold 30 from the location of conduit 50. During normal operations, damper 51 is opened and damper 52 is closed. However, when it is desired to clean one of the heat exchangers 24, 26 and 28, then damper 51 is preferably closed and damper 52 is opened, as shown in FIG. 1. A burner 54 is positioned upstream on injection line 50 and a source of air 56 passes through burner 54. Fuel is added to burner 54 through a fuel line 58. The air 56 is heated to the cleaning temperature for the heat exchanger. The cleaning temperature is selected to be high enough that it would volatilize and/or combust the organic solids which are to be expected in the heat exchanger 24, 26 and 28. Although the cleaning temperature may vary for the particular expected organic solvents, it would typically be above 600° F. A worker of ordinary skill in the art would be able to identify the necessary cleaning temperature for the particular expected organic solids, and would also be able to identify the amount of heat that must be added by the burner 54 to achieve that cleaning temperature in the desired volume of cleaning bake out air passing through injection line 50.

A fan 60 is positioned on outlet manifold 36 and serves to draw air from the combustion chamber to an outlet stack 61. An optional cooling air bleed 62 may be positioned on the outlet manifold 36 to insure that the air passing to fan 60 is not so hot that it may damage the fan 60.

In addition, a separate air inlet or supplemental injection line 64 may communicate with the purge manifold 42. The gas is preferably cooler than the gas in outlet stack 61. A damper 65 is preferably mounted on the normal purge tap and a second damper 66 is mounted on the supplemental injection line 64. During normal operation, damper 66 is maintained closed while damper 65 is open. The operation of the regenerative thermal oxidizer would continue as is normal to process gas from the inlet manifold 30.

When it is desired to bake out a particular heat exchanger, as heat exchanger 24 shown in FIG. 1, then damper 51 is closed and damper 52 is open. At the same time, damper 65 is closed and damper 66 is open. Heated air passes through conduit 50 and through the inlet branch 32 into the heat exchanger 24. This inlet gas is at the cleaning temperature and would volatilize and/or combust the organic solvents that may have accumulated within the heat exchanger 24. That gas passing into the combustion chamber 22 is then combined with a supplemental gas from purge branch 44 passing through heat exchanger 28. The supplemental injection gas is at a relatively low temperature, and serves to reduce the overall temperature of the combined gas flows passing out of combustion chamber 22, through heat exchanger 26, and into outlet manifold 36. Since the gas passing from injection line 50 and into the inlet branch 32 is at temperatures much higher than would typically be passing into the combustion chamber 20, it can be expected that the outlet temperature would be much higher than typically experienced by a regenerative thermal oxidizer. For that reason, the supplemental injected gas serves to reduce the overall temperature of the gas leaving the heat exchanger 26. Even so, the optional air bleed 62 will ensure that the temperature of the air approaching fan 60 is not so high as to be destructive to the fan.

The heat exchangers 26 and 28 are preferably cycled between the supplemental injection and outlet mode. This process continues until a sufficient time has passed that the heat exchanger 24 is thoroughly cleaned. At that time, the system may move to a mode wherein the heat exchanger 26 or 28 is cleaned. Alternatively, it may be preferable to have a period of no burn-out between the completion of cleaning of one of the heat exchangers to allow the overall system to return to a normal process temperature.

Figure 2:
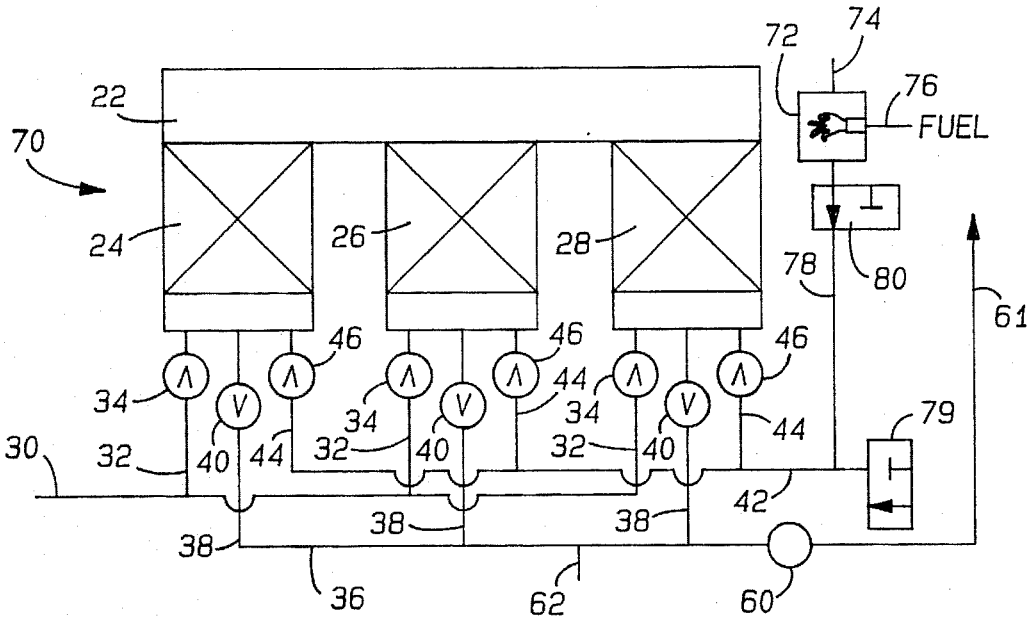
FIG. 2 is a schematic view of a second embodiment bake out system.

A second embodiment 70 is illustrated in FIG. 2. All elements which are identical to those shown in the first embodiment are identified with the same reference numerals. In this embodiment, the heated cleaning gas passes into the purge manifold 42 through a burner 72. Burner 72 communicates with a source of gas 74, which leads to an injection line 78. Injection line 78 is associated with a pair of dampers 79 and 80. Damper 79 serves to close off the purge source from the outlet stack 61. Damper 80 serves to open communication between injection line 78 and the purge manifold 42. As with the first embodiment, when a heat exchanger, here heat exchanger 28, is in the cleaning mode, the other two heat exchangers cycle between a supplemental injection mode and an outlet mode. Here, heat exchanger 24 is shown receiving supplemental injection air through the inlet manifold 30. This supplemental injection air may be the normal process gas, or may be an outside clean gas.

Preferred embodiments of this invention have been disclosed. A worker of ordinary skill in the art would recognize, however, that certain modifications would come within the scope of this invention. For that reason, the following claims should be studied to determine true scope and content of this invention.

We claim:

1. A method of cleaning a heat exchanger in a regenerative thermal oxidizer comprising the steps of:

providing a regenerative thermal oxidizer including a combustion chamber and at least two heat exchangers, each of said heat exchangers communicating with said combustion chamber at a first end of said heat exchanger and communicating with a source of process gas to be cleaned at a second end of said heat exchanger, said second end of said heat exchangers also communicating with an outlet manifold to direct a clean gas passing from said combustion chamber through said heat exchangers and to a destination for clean gas;

providing an injection line for passing a heated gas into said heat exchanger through said second end towards said first end and into said combustion chamber, a valve being provided on said injection line and a source of heat being provided on said injection line upstream of said valve;

heating and injection gas in said injection line with said source of heat; and passing said heated injection gas through said injection line and into said heat exchanger at said second end, passing said gas over said heat exchanger from said second end toward said first end and into said combustion chamber through a first of said heat exchangers, and passing gas from said combustion chamber through a second of said heat exchangers to said outlet manifold.

2. A method as recited in claim 1, wherein said gas passing into said injection line is heated to a cleaning temperature selected to be high enough to volatilize organic solids which are expected to be on said heat exchanger.

3. A method as recited in claim 2, wherein said cleaning temperature is above 600° F.

4. A method as recited in claim 1, wherein a fan is positioned on said outlet manifold for assisting in driving the air, and a tap is provided upstream of said fan, said tap being opened to provide supplemental cooling air to a outlet gas flow to prevent damage to said fan.

5. A method as recited in claim 1, wherein a period of cool down time is provided after completion of burn-out of a first of said heat exchangers prior to beginning a burn-out of said second of said heat exchangers.

6. A method of cleaning a heat exchanger in a regenerative thermal oxidizer comprising the steps of:

providing a regenerative thermal oxidizer including a combustion chamber and at least two heat exchangers, each of said heat exchangers communicating with said combustion chamber at a first end of said heat exchanger and communicating with a source of process gas to be cleaned at a second end of said heat exchanger, said second end of said heat exchangers also communicating with an outlet manifold to direct a clean gas passing from said combustion chamber through said heat exchangers and to a destination for clean gas;

providing an injection line for passing a heated gas into said heat exchanger through said second end towards said first end and into said combustion chamber;

passing a heated injection gas through said injection line and into said heat exchanger at said second end, passing said gas over said heat exchanger from said second end toward said first end and into said combustion chamber through a first of said heat exchangers, and passing gas from said combustion chamber through a second of said heat exchangers to said outlet manifold;

said gas passing into said injection line being heated to a cleaning temperature selected to be high enough to volatilize organic solids which are expected to be on said heat exchanger; and wherein there are at least three of said heat exchangers, with a first of said heat exchangers receiving said heated gas, a second of said heat exchangers receiving said outlet gas, and a third of said heat exchangers passing a cool supplemental injection gas through said third heat exchanger from said second end toward said first end and into said combustion chamber.

7. A method as recited in claim 6, wherein said heated gas is injected into an inlet manifold for directing a process gas into said heat exchanger.

8. A method as recited in claim 7, wherein a damper closes communication between a source of process gas and said inlet manifold, and a second damper opens communication between said injection line and said inlet manifold.

9. A method as recited in claim 7, wherein the cool gas passing into said third heat exchanger is supplied from a purge manifold for purging said heat exchanger.

10. A method as recited in claim 6, wherein said heated gas is directed through a purge manifold associated with a purge mode for said heat exchanger,

11. A method as recited in claim 10, wherein a separate injection line is selectively added into said purge manifold for delivering said heated gas.

12. A method as recited in claim 10, wherein said supplemental injection gas is a cool gas directed through said inlet manifold into said third heat exchanger.

13. A method as recited in claim 12, wherein said cool gas injected through said inlet manifold is a normal process gas for the regenerative thermal oxidizer.

* * * * *